US005131346A

United States Patent [19]

Ohta et al.

[11] Patent Number: 5,131,346

[45] Date of Patent: Jul. 21, 1992

[54] SMALL JET PROPELLED WATERCRAFT

[75] Inventors: Nobuharu Ohta; Susumu Shibayama, both of Iwata, Japan

[73] Assignee: Yamaha Hatsudoki Kabushiki Kaisha, Iwata, Japan

[21] Appl. No.: 729,938

[22] Filed: Jul. 15, 1991

[30] Foreign Application Priority Data

Jul. 13, 1990 [JP] Japan ..... 2-186757

[51] Int. Cl.[5] ..... B63B 35/00

[52] U.S. Cl. ..... 114/270; 114/363

[58] Field of Search ..... 440/38; 114/270, 363

[56] References Cited

U.S. PATENT DOCUMENTS 4,688,509 8/1987 Nishida ..... 114/270

4,898,114 2/1990 Asakura ..... 114/270

4,979,454 12/1990 Van Den Heuvel ..... 114/270

FOREIGN PATENT DOCUMENTS 2-169389 2/1990 Japan .

*Primary Examiner*—Jesus D. Sotelo

*Assistant Examiner*—Stephen P. Avila

*Attorney, Agent, or Firm*—Ernest A. Beutler

[57] ABSTRACT

A small watercraft of the jet propelled type designed to be operated by a rider standing on a deck to the rear of a control mast. The deck is defined by a pair of upstanding sidewalls that are spaced apart a greater distance where they join the deck than above the deck so that a rider may place his feet in widely spaced fashion, but brance his legs against the inwardly extending portions of the upwardly extending projections.

3 Claims, 3 Drawing Sheets

SMALL JET PROPELLED WATERCRAFT

BACKGROUND OF THE INVENTION

This invention relates to a small jet propelled watercraft and more particularly to an improved watercraft of this type which is designed to be operated by a rider in standing fashion.

There is a very popular small type of watercraft, normally jet propelled, in which the operator operates the watercraft primarily in a standing position. The watercraft is controlled by a pivotally supported mast that effects both steering and throttle control for the propulsion unit of the watercraft. Normally this type of watercraft is operated by a rider wearing a swimming or wet suit since it is quite common for the operator to become wet during its operation. In fact, it is not at all uncommon for the watercraft to become partially submerged or even capsize during the sporting activities with it.

With this type of watercraft, as noted, the operator normally operates the watercraft in a standing fashion and stands on a relatively open deck positioned behind the controlling mast. Normally this deck is either fully opened or is enclosed by a pair of outwardly diverging sides so as to provide a relatively wide foot area for the operator. However, the deck construction does not afford any way in which the operator may brace his feet or legs during maneuvering and hence can be very tiring and difficult to operate. In addition, the operator may have difficulty maintaining his balance.

It is, therefore, a principal object of this invention to provide a small watercraft of the type designed to be operated by a rider in standing fashion and wherein the deck affords a way in which the operator may brace himself when maneuvering while still affording a wide foot area.

It is a further object of this invention to provide an improved deck construction for a small watercraft.

It is a further object of this invention to provide a deck construction for a small watercraft that is operated in the standing fashion wherein a bracing arrangement is provided for the side of the operator's legs.

SUMMARY OF THE INVENTION

This invention is adapted to be embodied in a small watercraft of the type having a generally open deck on which a rider may stand. A propulsion unit control device is provided forwardly of the deck for permitting the operator to operate and control the watercraft. In accordance with the invention, the deck has a relatively wide foot area that is defined by a pair of upwardly extending sides that are narrower at their top than at their bottom so as to provide a side bracing area for the legs of the operator.

FURTHER DESCRIPTION OF THE PRIOR ART

Figure 1:
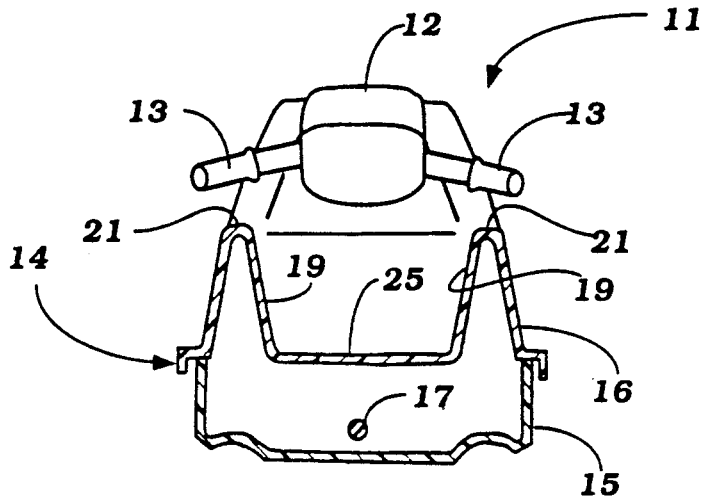
Figure 1 Prior Art
FIG. 1 is a transverse cross sectional view taken through the deck area of a prior art type of watercraft of the general type to which the invention relates.
Figure 2:
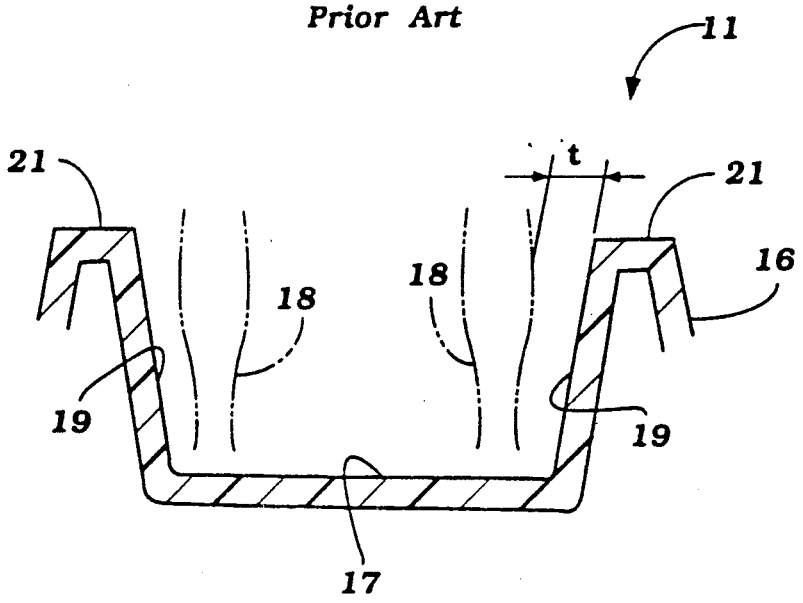
Figure 2 Prior Art
FIG. 2 is an enlarged view showing the prior art deck area and the rider's feet and legs in relation to it.
Figure 3:
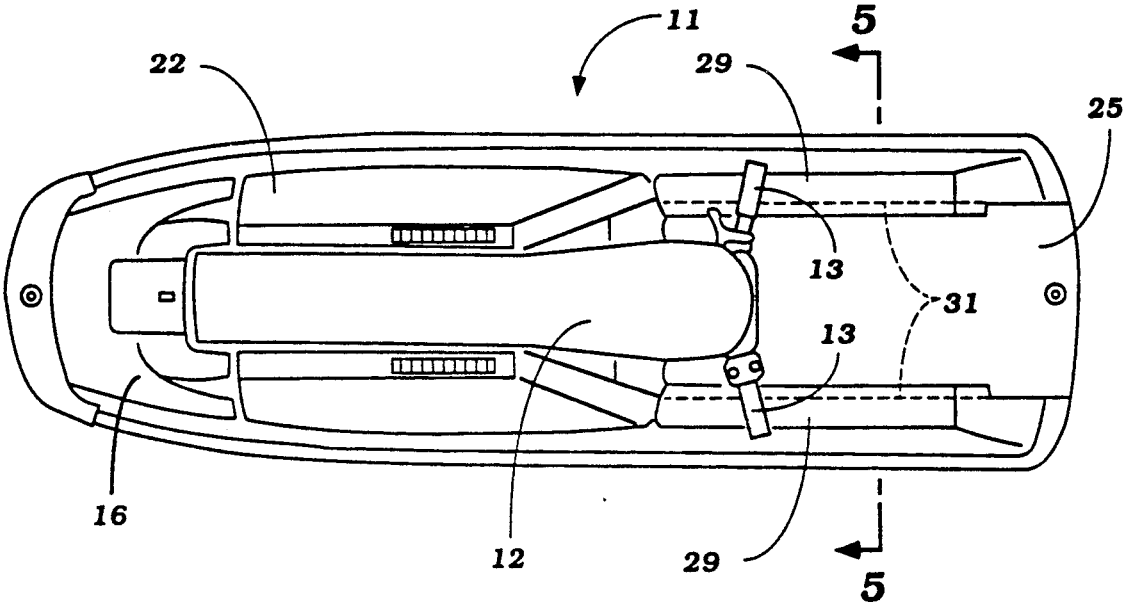
FIG. 3 is a top plan view of a small watercraft constructed in accordance with an embodiment of the invention.
Figure 4:
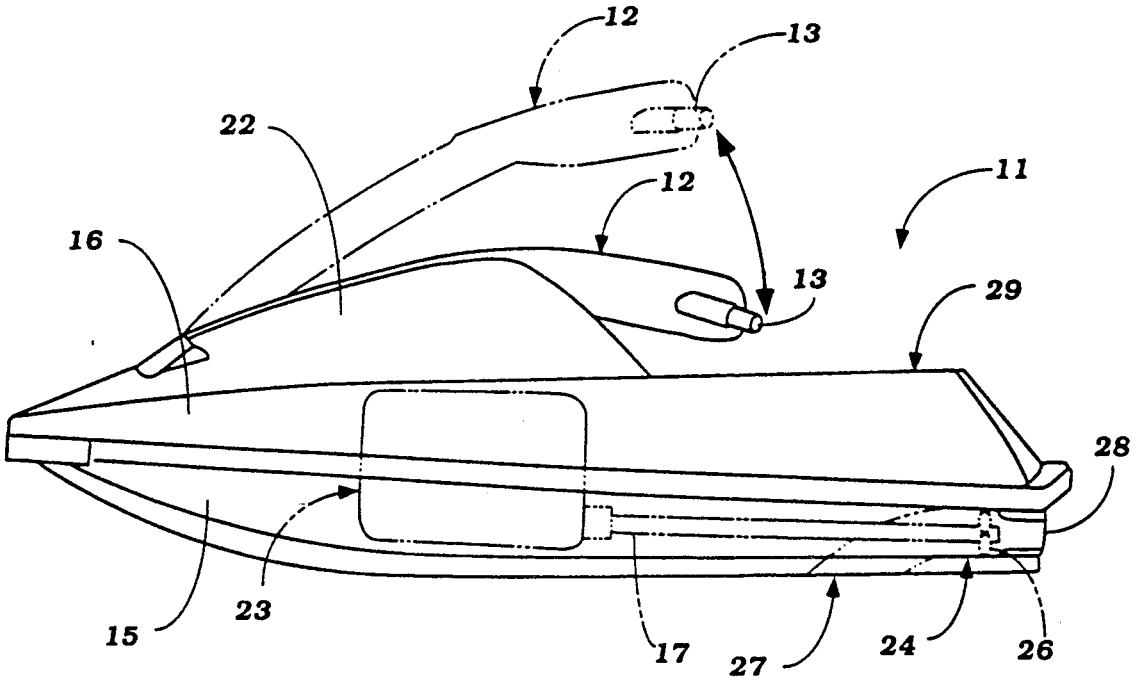
FIG. 4 is a side elevational view thereof, showing the controlling mast in a lowered, nonoperating position in solid lines and in a raised operating position in phantom lines.

In FIGS. 1 and 2, a conventional prior art type of small watercraft is identified generally by the reference numeral 11 and is shown in a transverse cross section in the two figures taken through the rear of the deck area. This type of watercraft 11 has a general configuration, as will be described, and includes a control mast 12 having a pair of handlebars 13 which afford steering of the watercraft and also throttle control for its propulsion unit. The watercraft includes a hull, indicated generally by the reference numeral 14 that is comprised of a lower section 15 and an upper section 16, which may be formed from materials such as molded fiberglass reinforced resin or the like. The sections 15 and 16 are secured together in a known manner.

A jet propulsion unit (not shown in these figures) is contained in a tunnel at the rear of the hull 14 and has an impeller driven by an impeller shaft 17 in a manner which will be described by reference to the preferred embodiment. As may be seen, there is provided in the deck portion 16 a deck 17 that extends transversely across the watercraft and which is accommodated to accept the feet and legs of a rider shown in phantom at 18 in FIG. 2. The rider normally operates the watercraft in a standing fashion, although pivotal movement of the mast 12 does permit some operation in kneeling or seated positions.

With the prior art constructions, the sides of the deck 17 are defined by a pair of outwardly tapered side walls 19 that terminate in upper edges 21 that are positioned above the deck 17. The rear of the deck 17 is generally opened to the rear of the watercraft so as to afford ease of entry and also so as to allow water to escape. As has been previously noted, this type of watercraft frequently may be partially submerged or even capsized, due to its sporting nature.

As may be seen in FIG. 2, the rider's legs 18 are normally positioned at a fairly wide spaced apart relationship on the deck 17 so as to permit good stability. However, the sidewalls 19, because of their outward taper, leave a gap t between the legs of the rider and the sides of the hull. As a result, the operator has no way of bracing himself from side to side and this gives rise to the difficulties as aforenoted.

DETAILED DESCRIPTION OF THE PREFERRED EMBODIMENT

The preferred embodiment of the invention will now be described by particular reference to FIGS. 3 through 6. In these figures, components which are generally the same as those of the prior art construction or are the same have been identified by the same reference numerals. The differences between this construction and the prior art will be stressed during the descriptive portion.

As may be seen in these figures, the mast 12 is pivotally supported at the forward portion of the watercraft adjacent and forwardly of an engine cover 22. An internal combustion engine 23 is positioned beneath the engine cove 22 and drives the impeller shaft 17.

A jet propulsion unit, shown in phantom and identified generally by the reference numeral 24, as aforereferred to, is positioned in a tunnel which is positioned beneath the deck, indicated by the reference numeral 25 in these figures due to its difference from the prior art constructions. The jet propulsion unit 24 is of the type well known in this art and includes an impeller 26 driven by the impeller shaft 17 and which draws water through a downwardly facing water inlet 27 and expels it rearwardly through a discharge nozzle 28 which may also be pivotally moved for steering of the watercraft by operation of the handlebars 13 in a well known manner.

Figure 5:
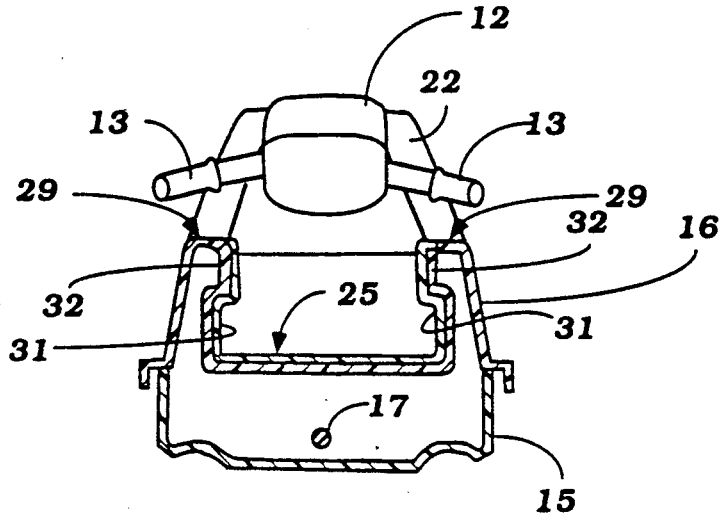
FIG. 5 is a transverse cross sectional view, in part similar to FIG. 1, taken generally along the line 5—5 of FIG. 3, and shows the construction in accordance with the embodiment of the invention.
Figure 6:
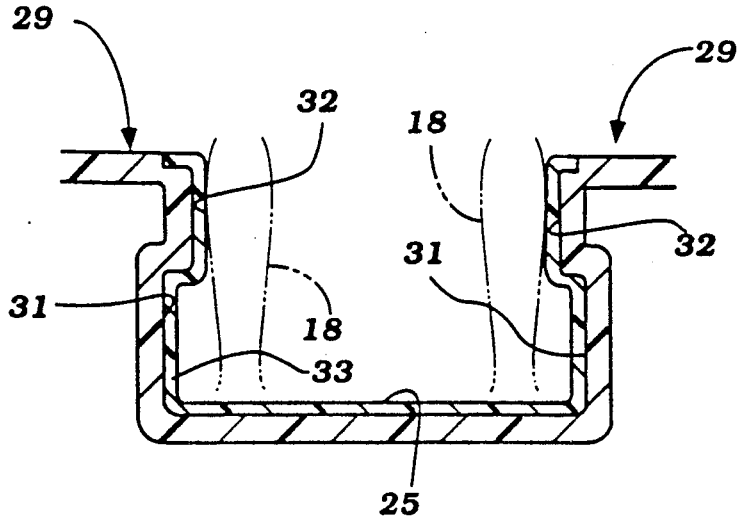
FIG. 6 is a cross sectional view, in part similar to FIG. 2, and shows this embodiment of the invention.

As may be best seen in FIGS. 5 and 6, the deck 25 is enclosed by a pair of generally raised areas 29, like the prior art construction. However, in accordance with this invention, the lower sides of the deck 25 are defined by spaced apart walls 31 which are spaced a large distance from each other so as to permit the operator to place his legs 18 in a widely spread position. However, upwardly of the portions 31, the raised portions 29 have inwardly extending areas 32 which are spaced apart a substantially closer distance than the portions 31. As a result, and as may be clearly seen in FIG. 6. the operator may then easily place his legs against these portions 32 for bracing.

In accordance with a preferred embodiment of the invention, a resilient pad like liner, indicated generally by the reference numeral 33, is positioned along the inner periphery of the sides 31 and 32 so as to afford cushioning. In addition, this liner may be textured so as to improve the grip of the operator's feet on the deck 25.

It should be readily apparent from the foregoing description that the described construction provides a very convenient and wide deck area for the operator's feet, but also provides bracing areas against which the rider's legs may be braced to improve stability without decreasing the width available for the rider's feet. Of course, the foregoing description is that of a preferred embodiment of the invention. Various changes and modifications may be made without departing from the spirit and scope of the invention, as defined by the appended claims.

We claim:

1. A small watercraft designed to be operated by a rider standing on a deck area for controlling the watercraft by a control positioned forwardly of the deck area, said watercraft having a hull defining a generally planar rider's area defined between a pair of upstanding sidewalls, said sidewalls having a lower portion spaced apart a greater distance an upper portion formed at the upper ends of said lower portion so as to permit a wide spacing of the rider's feet and to accommodate bracing of the sides of the rider's legs on the upper ends thereof, said lower portion and said upper portion of said sidewalls being interconnected by a generally horizontally extending surface extending substantially parallel to said rider's area to form a stepped configuration, the vertical height of said lower portion being sufficient so that said upper portion may be engaged by a portion of the rider's legs substantially above his feet so as to provide adequate side bracing while according a large and widely spread foot area.

2. A small watercraft as set forth in claim 1 wherein the watercraft is propelled by a jet propulsion unit positioned in a tunnel beneath the deck.

3. A small watercraft as st forth in claim 1 wherein the deck and sidewalls are lined with a resilient material.

* * * * *

UNITED STATES PATENT AND TRADEMARK OFFICE

CERTIFICATE OF CORRECTION

PATENT NO. : 5,131,346

DATED : July 21, 1992

INVENTOR(S) : Ohta, et al

It is certified that error appears in the above-identified patent and that said Letters Patent is hereby corrected as shown below:

Abstract line 7, "brance" should be --brace--.

Column 4, line 16, Claim 1, after "distance" insert --than--.

Column 4, line 33, Claim 3, "st" should be --set--.

Signed and Sealed this

Twelfth Day of October, 1993

*Attest:*

Bruce Lehman

BRUCE LEHMAN

*Attesting Officer*

*Commissioner of Patents and Trademarks*